US006112798A

United States Patent [19]

Cheng

[11] Patent Number: 6,112,798

[45] Date of Patent: Sep. 5, 2000

[54] MANUAL/AUTO DUAL DRIVING MODE TRANSMISSION MECHANISM FOR A VERTICAL BLIND

[76] Inventor: Keng Mu Cheng, Rm. 700, 7F, No. 380, Linsen N. Road, Taipei, Taiwan

[21] Appl. No.: 09/346,959

[22] Filed: Jul. 2, 1999

[51] Int. Cl.[7] ..... E06B 9/36

[52] U.S. Cl. ..... 160/176.1 P; 160/176.1 V

[58] Field of Search ..... 160/168.1 V, 168.1 P, 160/176.1 V, 176.1 P, 177 V, 178.1 V; 74/625

[56] References Cited

U.S. PATENT DOCUMENTS

| | | | |
|---|---|---|---|
| 2,149,481 | 3/1939 | Bosch et al. | 160/176.1 P |
| 3,068,938 | 12/1962 | Hull | 160/176.1 V |
| 4,224,973 | 9/1980 | Hugin | 160/176.1 V |
| 4,593,218 | 6/1986 | Streeter | 160/176.1 P |
| 4,657,060 | 4/1987 | Kaucic . | |
| 4,848,288 | 7/1989 | Murase et al. | 74/625 |
| 4,934,438 | 6/1990 | Yuas et al. | 160/176.1 P |
| 5,413,162 | 5/1995 | Ciriaci | 160/177 V |
| 5,575,323 | 11/1996 | Smuckler | 160/177 V |

*Primary Examiner*—Blair M. Johnson

*Attorney, Agent, or Firm*—Pro-Techtor International Services

[57] ABSTRACT

A manual/auto dual driving mode transmission mechanism installed in the headrail of a vertical blind and operated to rotate vertical slats of the vertical blind, the transmission mechanism including a motor drive unit controlled by a remote controller to rotate the rotary main shaft in the headrail of the vertical blind in turning the vertical slats to adjust the light, and a chain drive unit for pulling by hand to rotate the rotary main shaft of the vertical blind manually when the remote controller or the motor of the motor drive fails.

3 Claims, 7 Drawing Sheets

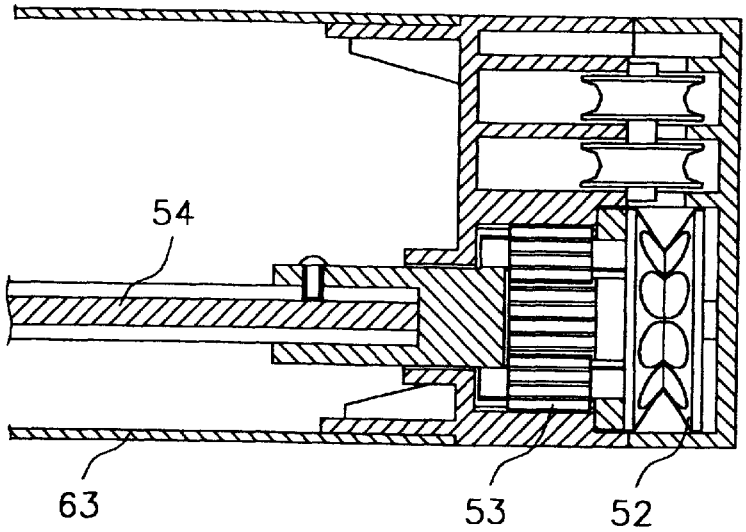
*FIG. 2* *(Prior Art)*
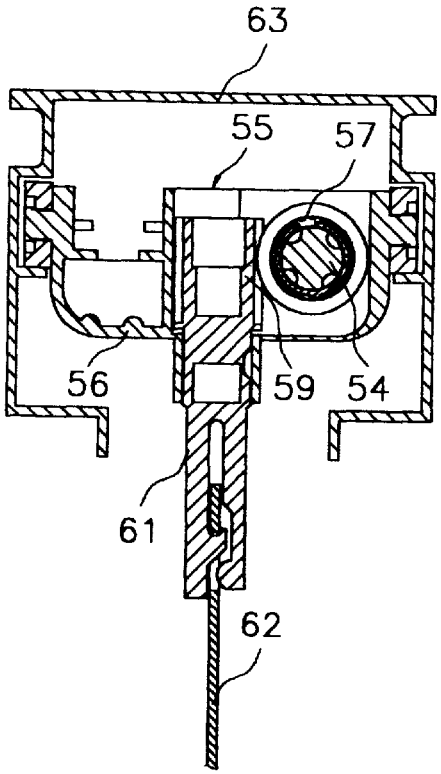
*FIG. 3* *(Prior Art)*

MANUAL/AUTO DUAL DRIVING MODE TRANSMISSION MECHANISM FOR A VERTICAL BLIND

BACKGROUND OF THE INVENTION

The present invention relates to a transmission mechanism for a vertical blind having vertical slats, and more particularly to a manual/auto dual driving mode transmission mechanism that can be operated manually, or automatically through a reversible motor. Further, the transmission mechanism can be controlled through a remote controller.

Regular blinds are commonly operated by hand. FIG. 1 illustrates a vertical blind 50 with vertical slats 52 according to the prior art. As illustrated in FIGS. 2 and 3, the blind 50 comprises a chain wheel 52, a chain 51 mounted on the chain wheel 52 and pulled by hand to rotate the chain wheel 52, a rotary main shaft 54, a coupling 53 coupled between the chain wheel 52 and the rotary main shaft 54 for rotating the rotary main shaft 54 upon rotary motion of the chain wheel 52, a set of carriers 55, each carrier 55 having a casing 56 and a worm gear 59 in the casing 56, a worm 57 rotated with the rotary main shaft 54 and meshed with the worm gear 59 in the casing 56 of each of the carriers 55, a plurality of hooks 61 respectively coupled to the worm gear 59 in the casing 56 of each of the carriers 55, and a plurality of vertical slats 62 respectively hung on the hooks 61. By pulling the chain 51 to rotate the chain wheel 52, the vertical slats 62 are rotated with the worm gear 59 in each of the carriers 55 to the desired angle to regulate the light. In regulating the light, this structure of blind is functional, however it must be operated by hand with much effort.

SUMMARY OF THE INVENTION

The present invention has been accomplished to provide a transmission mechanism for a blind, which eliminates the aforesaid drawback. The transmission mechanism according to the present invention comprises a motor drive unit and a chain drive unit. The motor drive unit is controlled by a remote controller to rotate the rotary main shaft in the headrail of the vertical blind, causing the vertical slats of the vertical blind to be rotated to adjust the light. If the remote controller or the motor of the motor drive unit fails, the chain drive unit can be operated by hand to rotate the rotary main shaft of the vertical blind manually.

BRIEF DESCRIPTION OF THE DRAWINGS

FIG. 2 is a sectional view in an enlarged scale taken along line 2—2 of FIG. 1.

FIG. 3 is a longitudinal view in section of the transmission mechanism shown in FIG. 2.

DETAILED DESCRIPTION OF THE PREFERRED EMBODIMENT

Figure 1:
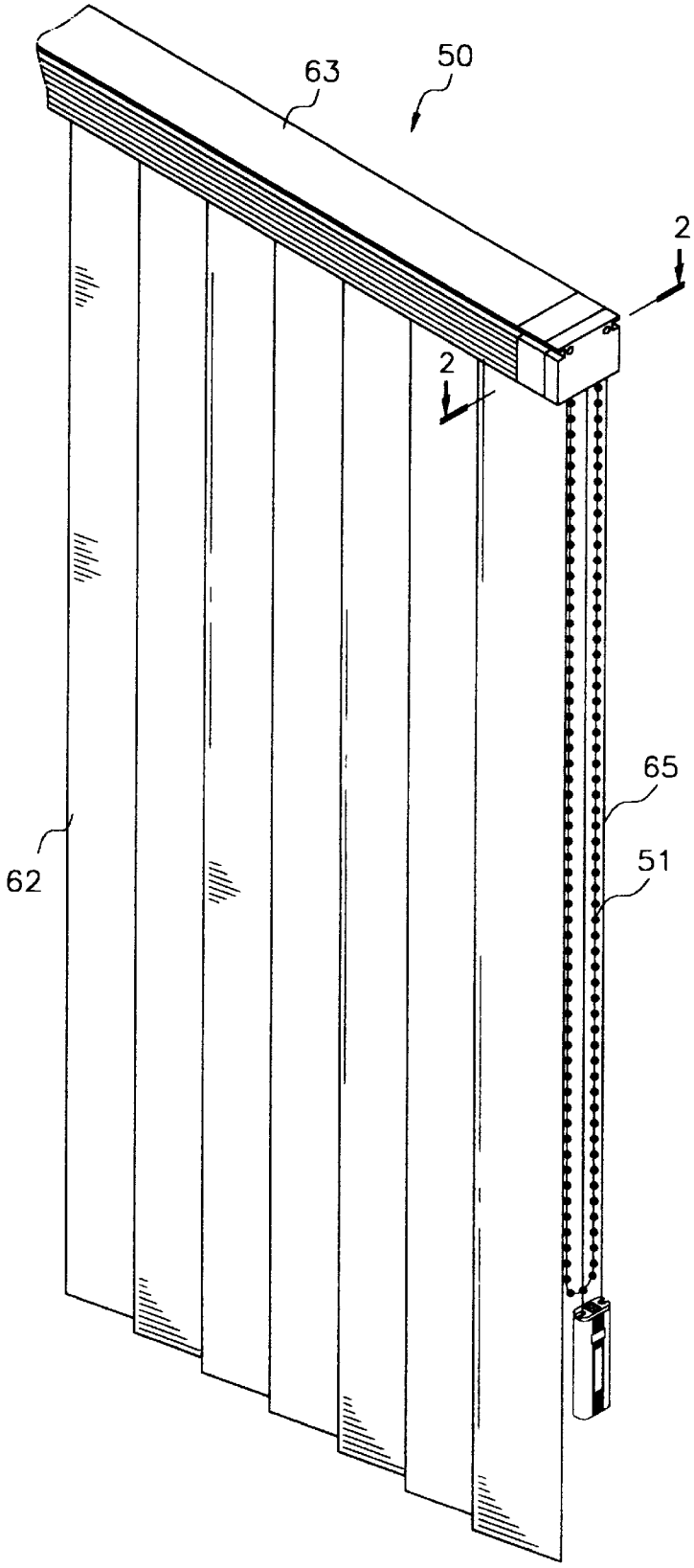
FIG. 1 (Prior Art)
FIG. 1 illustrates a conventional vertical blind.
Figure 4:
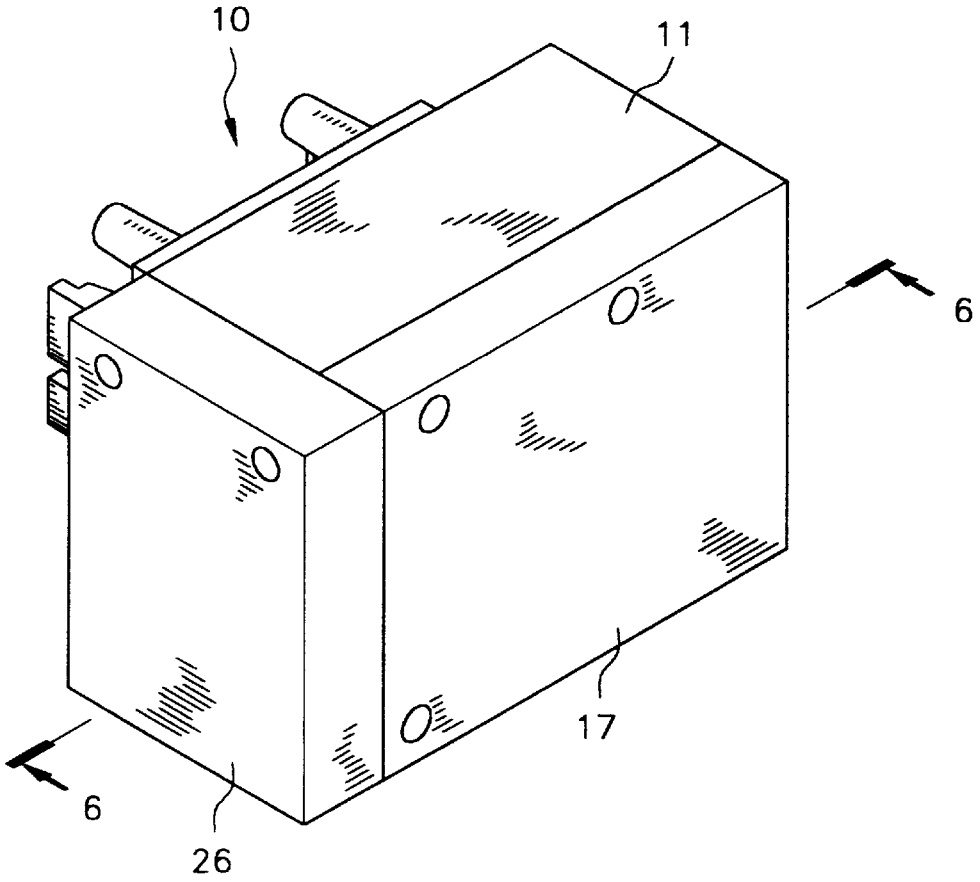
FIG. 4 is an elevational view of a transmission mechanism for a vertical blind according to the present invention.
Figure 6:
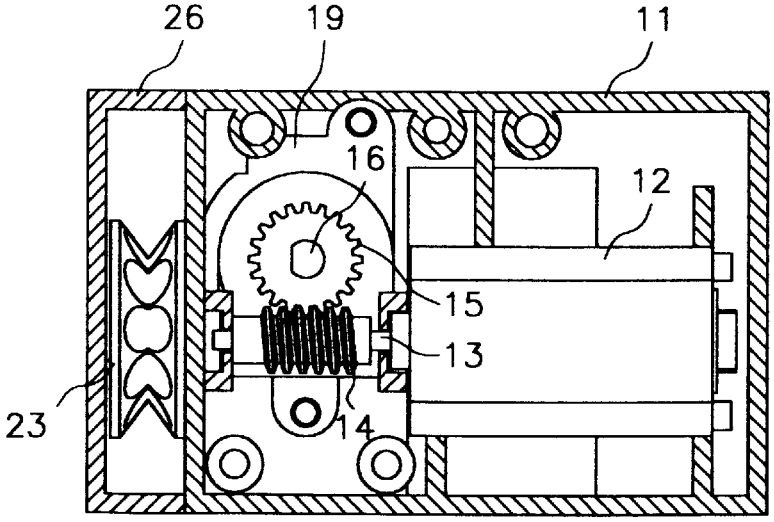
FIG. 6 is a sectional view taken along line 6—6 of FIG. 4.
Figure 10:
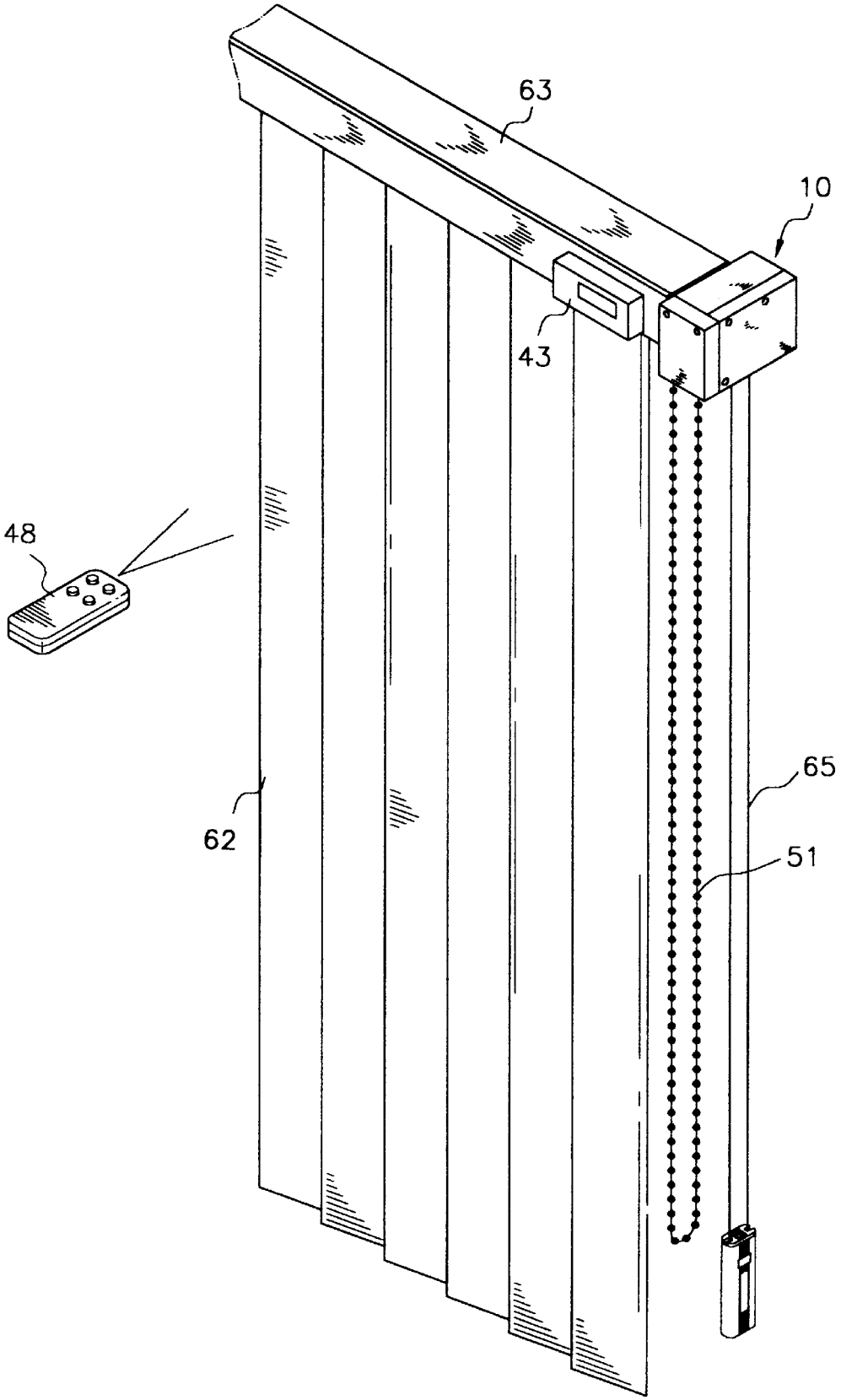
FIG. 10 is an elevational view of a vertical blind equipped with a transmission mechanism according to the present invention.

Referring to FIGS. from 4 through 10, a transmission mechanism 10 is installed in one end of the headrail 63 of a vertical blind, and controlled to turn the vertical slats 62 of the vertical blind (see FIG. 10). The transmission mechanism 10 has a substantially box-like outer appearance. After installation, the transmission mechanism 10 forms a part of the vertical blind, and causes a sense of beauty. The transmission mechanism 10 comprises a casing 11, the casing 11 having an axle hole 22 at its one lateral side wall and a recessed axle seat 20 on the inside corresponding to the axle hole 22, a DC motor 12 mounted in the casing 11, a first worm 14 fixedly connected to the output shaft 13 of the DC motor 12, a first worm gear 15 mounted in the casing 1 and meshed with the first worm 14 (see FIG. 6), a transmission shaft 16 mounted in the casing 1 and rotated with the first worm gear 15, a back cover 17 covered on the back open side of the casing 11, an axle bearing 19 fixedly mounted inside the casing 11 by screws to support the transmission shaft 16, enabling the transmission shaft 16 to be smoothly rotated with the first worm gear 15, a wheel axle 21 mounted in a chamber 20 in the axle bearing 19 inside the casing 11 and having one end extended out of the casing 11 through the axle hole 22, a chain wheel 23 fixedly mounted on the wheel axle 21 outside the casing 11, a chain 51 mounted on the chain wheel 23 and pulled by hand to rotate the chain wheel 23, a second worm 25 fixedly mounted on the wheel axle 21 inside the casing 11, a second worm gear 27 rotatably mounted on one end of the transmission shaft 16 remote from the first worm gear 15 and meshed with the second worm 25, and a side cover 26 covered on the casing 11 at one side to protect the chain wheel 23, and to keep the chain 51 in engagement with the chain wheel 23. Because the second worm gear 27 is rotatably mounted on the transmission shaft 16 and meshed with the second worm 25, the transmission shaft 16 is immovable when the second worm gear 27 is rotated by the second worm 25. On the other hand, when the transmission shaft 16 is driven to rotate by the DC motor 12, the second worm gear 27 is maintained immovable. This design enables the transmission mechanism 10 to be operated manually or automatically as desired (this will be described further). The second worm gear 27 is received in the chamber 20, and connected to one side wall 31 of an internal gear 32 by pins 29. Therefore, the internal gear 32 is synchronously rotated with the second worm gear 27 upon rotary motion of the second worm 25. According to this embodiment, the second worm gear 27 is connected to the internal gear 32 by pins 29. Alternatively, the second worm gear 27 can be made integral with one side wall 31 of the internal gear 32. The internal gear 32 is meshed with four small gears 34. The small gears 34 are revolvably supported on an axle coupling 33 at one end, and spaced from one another at a pitch of 90° angle. A gear 24 is mounted on the transmission shaft 16 and meshed with the small gears 34 inside the axle coupling 33. The axle coupling 33 comprises an extension tube 35 at one end. The extension tube 35 is extended out of the casing 11 and a mounting frame 37, and sleeved on one end of a rotary main shaft 54 in the headrail 63 of the vertical blind, and then fixedly secured to the main shaft 54 by screws 44. Therefore, the main shaft 54 can be rotated with the axle coupling 33. The mounting frame 37 is covered on the front open side of the casing 11, having a plurality of coupling flanges 39 raised from its front side wall, which are plugged into respective coupling grooves 64 in one end of the headrail 63 to secure the mounting frame 37 to the headrail 63, and two wheel housings 41 raised from its back side wall and inserted into the casing 11 (see FIG. 7). A fixed axle 30 is mounted in the wheel housings 41. Two pulleys 42 are respectively mounted in the wheel housings 41, and supported on the fixed axle 30. A pull cord 65 is coupled to the pulleys 42, and extended out of a hole (not shown) at the bottom side wall of the casing 11 for pulling by hand. Pulling the pull cord 65 causes a set of carriers 55 to be moved along the rotary main shaft 54. By pulling the pull cord 65 to move the carriers 55 forwards/backwards along the rotary main shaft 54, the vertical slats 62 of the vertical blind are received at one side, or extended out (the operation of the pull cord 65 to move the vertical slats 62 is of the known art and not within the scope of the present invention, therefore it is not described in detail).

Figure 5:
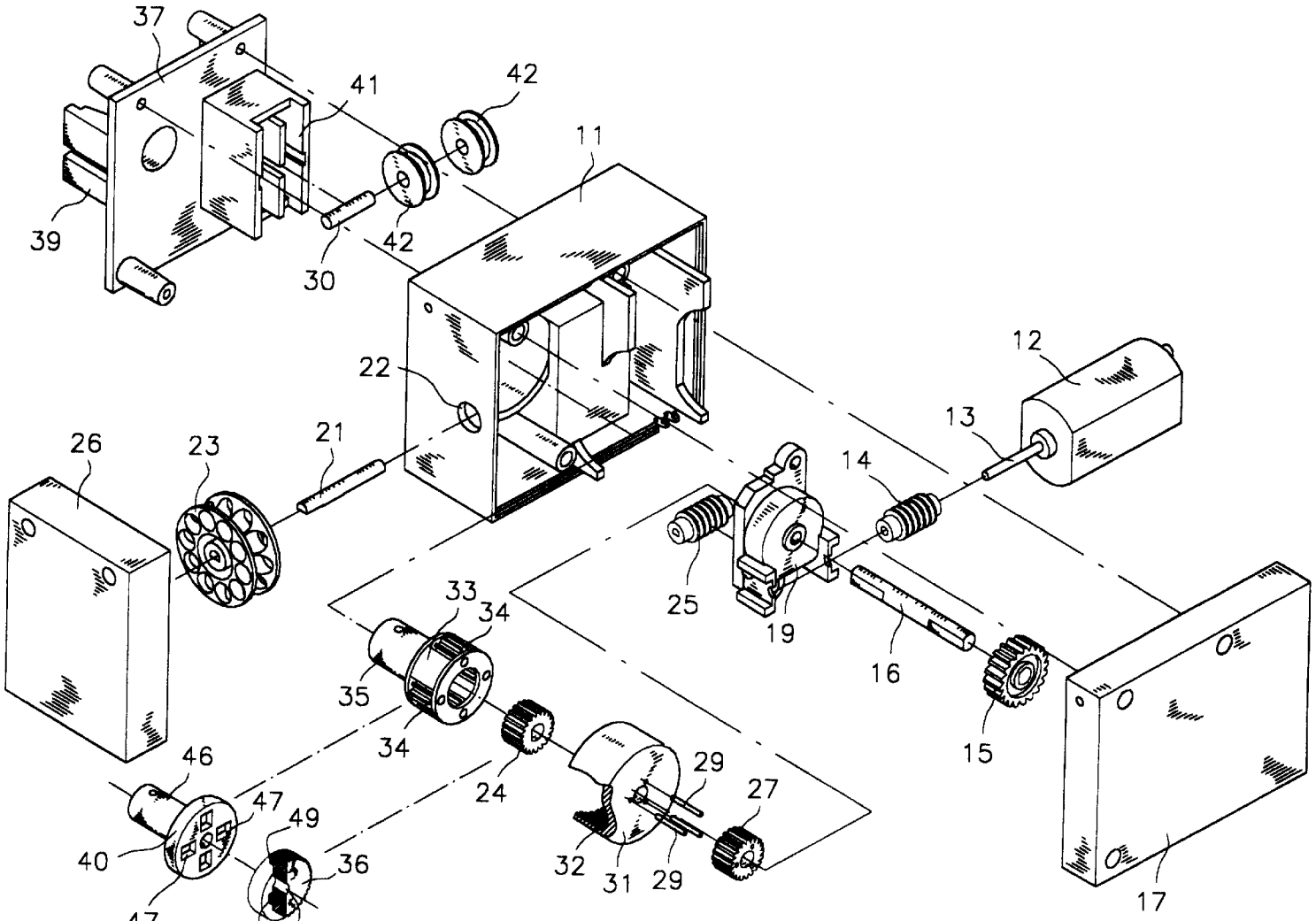
FIG. 5 is an exploded view of the transmission mechanism shown in FIG. 4.
Figure 9:
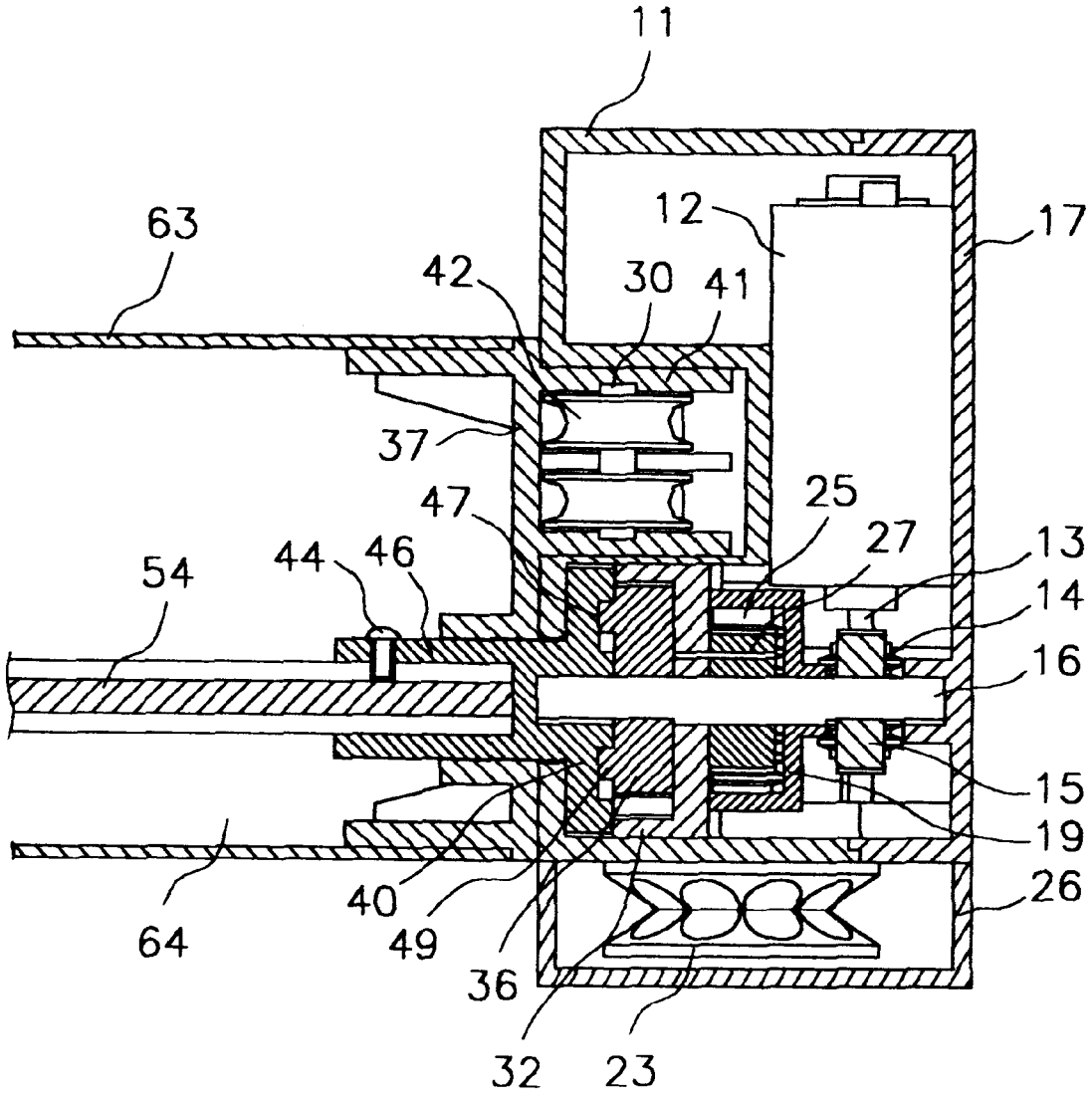
FIG. 9 is a cross sectional view of an alternate form of the transmission mechanism according to the present invention.

Referring to FIGS. 5 and 9, an eccentric gear wheel 36 and a connector 40 may be used instead of the aforesaid gear 24 and axle coupling 33. The eccentric gear wheel 36 is meshed with the internal gear 32, comprising an eccentric hole 45 coupled to the transmission shaft 16 for enabling the eccentric wheel 36 to be rotated with the transmission shaft 16 in the internal gear 32, and a plurality of equiangularly spaced plug rods 49 raised from a front side wall thereof and coupled to the connector 40. The connector 40 comprises an extension tube 46 perpendicularly raised from a front side wall thereof and fixedly connected to one end of the rotary main shaft 54 by screws 44, and a plurality of plug holes 47 equiangularly spaced at a back side wall thereof and respectively coupled to the plug rods 49 at the connector 40. Alternatively, the eccentric gear wheel 36 may be made integral with the connector 40.

Referring to FIGS. from 6 through 8, when the DC motor 12 is started, the first worm 14 is driven to rotate the first worm gear 15, thereby causing the transmission shaft 16 to be rotated with the first worm gear 15. Because the gear 24 is fixedly mounted on the transmission shaft 16 and meshed with the small gears 34, rotating the transmission shaft 16 causes the small gears 34 to be rotated (in the embodiment shown in FIG. 9, the connector 40 and the eccentric gear wheel 36 are rotated upon rotary motion of the transmission shaft 16), and therefore the rotary main shaft 54 is rotated with the axle coupling 33 (or the connector 40). Rotating the rotary main shaft 54 causes the worm 57 of each of the carriers 55 to rotate the respective worm gear 59, therefore the vertical slats 62 are rotated with the respective hooks 61 at each of the carriers 55 (see also FIG. 3).

Figure 7:
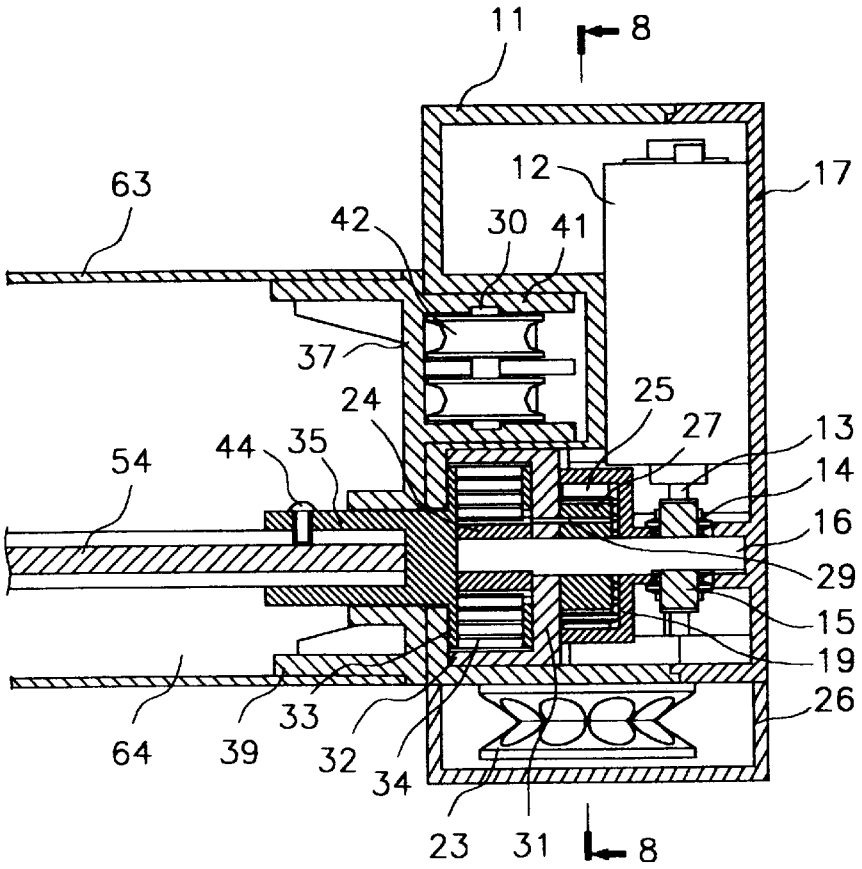
FIG. 7 is a cross sectional view of the present invention showing the transmission mechanism installed in the headrail of a vertical blind.
Figure 8:
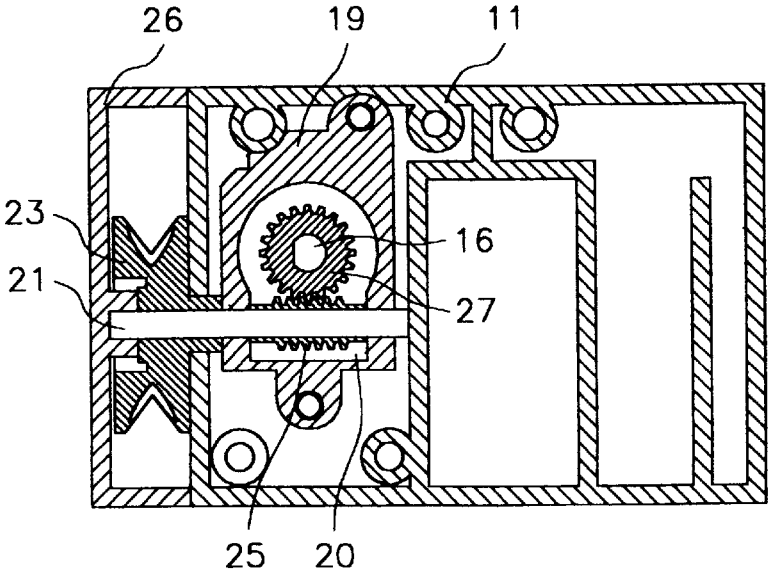
FIG. 8 is a sectional view taken along line 8—8 of FIG. 7.

Referring to FIGS. 7 and 8, when the DC motor 12 fails or is off, the pull chain 51 can be pulled by hand to rotate the chain wheel 23, causing the wheel axle 21 and the second worm 25 to rotate the second worm gear 27 via the second worm 25. During rotary motion of the second worm 25, the internal gear 32 is driven to rotate the small gears 34 (or the eccentric gear wheel 36, see FIG. 9), thereby causing the rotary main shaft 54 to be rotated with the axle coupling 33 (or the connector 40), and therefore the vertical slats 62 are rotated with the respective hooks 61 at each of the carriers 55 to regulate the light.

Referring to FIG. 10, a signal receiver 43 is mounted on the headrail 53 to receive control signal from a remote controller 48 for controlling the operation (forward rotation/backward rotation/stop) of the DC motor 12. The remote controller 48 can be operated to control forward/backward rotation of the DC motor 12 at one of three modes, namely, the one-step rotation mode, the multi-step rotation mode, and the stepless rotation mode. When the remote controller 48 is switched to the one-step rotation mode and the control button at the remote controller 48 is depressed, the vertical slats of the vertical blind are rotated to the full open or full close position. At this mode, the vertical blind can only be turned between two positions, namely, the full open position and the full close position. When the remote controller 48 is switched to the multi-step rotation mode and the control button at the remote controller 48 is clicked, the vertical slats of the vertical blind are rotated through one step, for example, 30° angle. At this mode, the vertical slats of the vertical blind can be rotated step by step to adjust the light. When the remote controller 48 is switched to the stepless rotation mode, the vertical slats of the vertical blind can be rotated stepless through 360° angle by keeping the control button at the remote controller 48 depressed. When the control button is released, the rotary motion of the vertical slats is immediately stopped. Therefore, the vertical slats of the vertical blind can be rotated stepless to the desired angle when at the stepless rotation mode.

It is to be understood that the drawings are designed for purposes of illustration only, and are not intended for use as a definition of the limits and scope of the invention disclosed. For example, a wired control device can be installed for controlling the operation of the DC motor.

What the invention claimed is:

1. A manual/auto dual driving mode transmission mechanism installed in the headrail of a vertical blind and operated to rotate vertical slats of the vertical blind, comprising:

a casing, said casing comprising a back open side covered with a back cover a front open side covered with a mounting frame fastened to the headrail of the vertical blind;

a pair of pulleys mounted in said mounting frame within said casing to support a pull cord for Dulling by hand to move a set of carriers along a rotary main shaft in the headrail of the vertical blind;

a reversible motor mounted inside said casing;

a first worm mounted inside said casing and rotated by said motor;

an axle bearing fixedly mounted inside said casing;

a transmission shaft supported in said axle bearing;

a first worm gear fixedly mounted on said transmission shaft and meshed with said first worm;

an internal gear turned about said transmission shaft;

a transmission gear fixedly mounted on said transmission shaft; and an axle coupling mounted in said casing, said axle coupling comprising a plurality of small gears equiangularly spaced at one end thereof and meshed with said transmission gear and an extension tube extended from an opposite end thereof and fixedly connected to the rotary main shaft in the headrail of the vertical blind;

wherein when said motor is rotated, said first worm is driven by said motor to rotate said first worm sear said transmission shaft and said transmission gear, causing said small gears to be rotated in said internal gear, and therefore said axle coupling is driven to rotate the rotary main shaft of the vertical blind;

a wheel axle mounted in said casing, said wheel axle having one end extended out of an axle hole at one lateral side of said casing;

a chain wheel fixedly mounted on said wheel axle outside said casing for the mounting of a chain to be pulled by hand to rotate said chain wheel;

a second worm fixedly mounted on said wheel axle inside said casing; and a second worm gear turned about said transmission shaft and meshed with said second worm and fixedly connected to said internal gear at one side for enabling said internal gear to be rotated with said second worm gear by said second worm in causing said axle coupling and the rotary main shaft of the vertical blind to rotate synchronously upon rotary motion of said chain wheel said wheel axle and said second worm.

2. A manual/auto dual driving mode transmission mechanism installed in the headrail of a vertical blind and operated to rotate vertical slats of the vertical blind, comprising:

a casing, said casing comprising a back open side covered with a back cover, a front open side covered with a mounting frame fastened to the headrail of the vertical blind;

a pair of pulleys mounted in said mounting frame within said casing to support a pull cord for pulling by hand to move a set of carriers along a rotary main shaft in the headrail of the vertical blind;

a reversible motor mounted inside said casing;

a first worm mounted inside said casing and rotated by said motor;

an axle bearing fixedly mounted inside said casing;

a transmission shaft supported in said axle bearing;

a first worm gear fixedly mounted on said transmission shaft and meshed with said first worm;

an internal gear turned about said transmission shaft;

an eccentric gear fixedly mounted on said transmission shaft and meshed with said internal gear; and a connector mounted in said casing, said connector having a back side wall connected to said eccentric wheel and a front extension tube fixedly connected to the rotary main shaft in the headrail of the vertical blind for enabling the rotary main shaft of the vertical blind to be rotated with said eccentric wheel;

wherein when said motor is rotated, said first worm is driven by said motor to rotate said first worm gear, said transmission shaft and said eccentric wheel, causing said connector to be driven to rotate the rotary main shaft of the vertical blind; further comprising:

a wheel axle mounted in said casing, said wheel axle having one end extended out of an axle hole at one lateral side of said casing;

a chain wheel fixedly mounted on said wheel axle outside said casing for the mounting of a chain to be pulled by hand to rotate said chain wheel;

a second worm fixedly mounted on said wheel axle inside said casing; and a second worm gear turned about said transmission shaft and meshed with said second worm and fixedly connected to said internal gear at one side for enabling said internal gear to be rotated with said second worm gear by said second worm in causing said eccentric wheel, said connector and the rotary main shaft of the vertical blind to rotate synchronously upon rotary motion of said chain wheel, said wheel axle and said second worm.

3. The manual/auto dual driving mode transmission mechanism of claim 2 wherein said connector comprises a plurality of plug holes equiangularly spaced at the back side wall thereof, and said eccentric wheel comprises a plurality of plug rods raised from a front side wall thereof and respectively plugged into the plug holes at said connector for enabling said connector to be rotated with said eccentric wheel.

* * * * *